US010378254B1

(12) United States Patent
Salter et al.

(10) Patent No.: US 10,378,254 B1
(45) Date of Patent: Aug. 13, 2019

(54) VEHICLE DOOR HANDLE HAVING PROXIMITY SENSORS FOR DOOR CONTROL AND KEYPAD

(71) Applicant: Ford Global Technologies, LLC, Dearborn, MI (US)

(72) Inventors: Stuart C. Salter, White Lake, MI (US); Kosta Papanikolaou, Huntington Woods, MI (US); Paul Kenneth Dellock, Northville, MI (US); David Brian Glickman, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 5 days.

(21) Appl. No.: 15/981,151

(22) Filed: May 16, 2018

(51) Int. Cl.
*E05B 81/76* (2014.01)
*E05B 85/10* (2014.01)
*E05B 85/16* (2014.01)

(52) U.S. Cl.
CPC ..... *E05B 85/103* (2013.01); *E05B 81/76* (2013.01); *E05B 85/107* (2013.01); *E05B 85/16* (2013.01)

(58) Field of Classification Search
CPC ..... E05B 85/103; E05B 81/76; E05B 85/107; E05B 85/16
USPC ..... 340/5.72
See application file for complete search history.

(56) References Cited

U.S. PATENT DOCUMENTS 7,911,321 B2 3/2011 Bingle et al.
8,091,280 B2 1/2012 Hanzel et al.
8,471,822 B2 6/2013 Lightenberg
8,701,353 B2 4/2014 Patel et al.
8,922,340 B2 12/2014 Salter et al.
9,137,856 B2 9/2015 Thompson et al.
9,151,089 B2 10/2015 Aerts et al.
9,346,470 B2 5/2016 Mittermeier
9,423,895 B2 8/2016 Adamson et al.
9,447,613 B2 9/2016 Salter et al.
9,512,662 B1 12/2016 Dudar et al.
9,637,088 B2 5/2017 Ette et al.
9,646,436 B1 5/2017 Campbell et al.
9,696,839 B1 * 7/2017 Bingle ..... G06F 3/0414
9,745,778 B1 * 8/2017 Bingle ..... E05B 81/78
10,124,767 B1 * 11/2018 Salter et al. ..... B60R 25/23
(Continued)

FOREIGN PATENT DOCUMENTS

CN 202261842 U 5/2012
CN 205086649 U 3/2016
(Continued)

OTHER PUBLICATIONS

Machine translation JP 2009079353 A.*
(Continued)

*Primary Examiner* — Steven Lim
*Assistant Examiner* — Kam Wan Ma
(74) *Attorney, Agent, or Firm* — Vichit Chea; Price Heneveld LLP

(57) ABSTRACT

A vehicle door handle is provided that includes a handle body having inner and outer sides, keypad contacts on the outer side, and a plurality of proximity sensors disposed on the handle body to generate sense activation fields extending on the inner and outer sides. The vehicle door handle also includes a controller processing signals generated by the sensors to determine a handle pull on the inner side and a keypad input on the outer side.

17 Claims, 7 Drawing Sheets

(56) References Cited

U.S. PATENT DOCUMENTS

| | | | | |
|---|---|---|---|---|
| 2003/0029210 | A1* | 2/2003 | Budzynski | E05B 85/10 70/278.1 |
| 2006/0071755 | A1* | 4/2006 | Muller | E05B 81/78 340/5.72 |
| 2007/0194878 | A1* | 8/2007 | Touge | G01S 7/282 340/5.2 |
| 2011/0148575 | A1* | 6/2011 | Sobecki | E05B 85/103 340/5.64 |
| 2012/0119524 | A1 | 5/2012 | Bingle et al. | |
| 2013/0033362 | A1* | 2/2013 | Hourne | H03K 17/962 340/5.72 |
| 2013/0244577 | A1* | 9/2013 | Cheikh | G07C 9/00309 455/41.1 |
| 2014/0000165 | A1* | 1/2014 | Patel | E05B 81/76 49/31 |
| 2014/0000167 | A1 | 1/2014 | Patel et al. | |
| 2014/0069015 | A1* | 3/2014 | Salter | E05B 81/76 49/31 |
| 2015/0315839 | A1 | 11/2015 | Shigemoto et al. | |
| 2015/0330112 | A1 | 11/2015 | Van Wiemeersch et al. | |
| 2015/0330117 | A1 | 11/2015 | Van Wiemeersch et al. | |
| 2016/0251880 | A1* | 9/2016 | Bingle | E05B 81/76 701/49 |
| 2016/0333627 | A1 | 11/2016 | Dudar et al. | |
| 2017/0016255 | A1* | 1/2017 | Guibbert | E05B 81/77 |
| 2017/0103592 | A1 | 4/2017 | Buttolo et al. | |
| 2017/0194960 | A1* | 7/2017 | Bextermoeller | E05B 81/77 |
| 2017/0232932 | A1 | 8/2017 | Nishidai et al. | |
| 2017/0260778 | A1 | 9/2017 | Witte et al. | |
| 2018/0283843 | A1* | 10/2018 | Adams | E05B 77/34 |

FOREIGN PATENT DOCUMENTS

| | | | |
|---|---|---|---|
| CN | 107575101 | A | 1/2018 |
| DE | 102006019581 | B4 | 11/2014 |
| DE | 102013013203 | A1 * | 2/2015 |
| JP | 2008063907 | A | 3/2008 |
| JP | 4146601 | B2 | 6/2008 |
| JP | 4161898 | B2 | 8/2008 |
| JP | 2009079353 | A * | 4/2009 |
| JP | 5309515 | B2 | 7/2013 |
| KR | 1020130094569 | A | 8/2013 |

OTHER PUBLICATIONS

"Touch Sensors Design Guide" by Atmel, 10620 D-AT42-Apr. 2009, Revised Apr. 2009, 72 pages, Copyrighted 2008-2009 Atmel Corporation.

Tesla Model S—Cold Weather Performance, Published Nov. 22, 2013 on YouTube, https://www.youtube.com/watch?v=GS9uDJGi52A&feature=c4-overview&list=UU5WjFrtBdufl6CZojX3D8dQ, 3 pages.

How to—Range Rover Velar (2017) Vehicle Feature: Gesture Tailgate, Published Jul. 14, 2017 on YouTube, https://www.youtube.com/watch?v=RjhYd2b1ZIE, 1 page.

U.S. Appl. No. 15/882,191 filed Jan. 29, 2018, entitled "Vehicle Exterior Keypad Having Interior Lamp," 4 pages of filing receipt, 13 pages of patent application and 6 pages of drawings.

* cited by examiner

VEHICLE DOOR HANDLE HAVING PROXIMITY SENSORS FOR DOOR CONTROL AND KEYPAD

FIELD OF THE INVENTION

The present invention generally relates to powered vehicle doors, and more particularly relates to a powered vehicle door having door control inputs sensed via proximity sensing.

BACKGROUND OF THE INVENTION

Automotive vehicles include various door assemblies for allowing access to the vehicle, such as passenger doors allowing access to the passenger compartment. The vehicle doors typically include a door handle and a latch assembly that latches the door in the closed position and is operable by a user to unlatch the door to allow the door to open. The doors may pivot or slide on a track between open and closed positions. Some vehicle doors are equipped with a motor to provide power door opening assist to open the door. Upon receiving the user input, the motor actuates the door to the open position typically at a constant speed. It is desirable to provide for vehicle door controls that provides enhanced functionality.

SUMMARY OF THE INVENTION

According to one aspect of the present invention a vehicle door handle is provided. The vehicle door handle includes a handle body having first and second sides and a plurality of proximity sensors disposed on the handle body and generating activation fields. The vehicle door handle also has a controller processing signals generated by the sensors to determine a handle pull on the first side and a keypad input on the second side.

Embodiments of the first aspect of the invention can include any one or a combination of the following features:

- the plurality of proximity sensors generate the activation fields to extend on the first side and the second side of the handle body;
- the first side of the handle body is an inner side and the second side of the handle body is an outer side;
- the door handle further comprises a beam shaping shield located between the sensors and the outer side to generate a narrower sensing field on the outer side of the handle body for each proximity sensor;
- the beam shaping shield comprises a conductive layer having one or more holes for controlling shape of the activation fields extending on the second side of the handle body;
- the door handle further comprises a plurality of keypad contact surfaces on the outer side of the handle body;
- the plurality of proximity sensors comprises a plurality of capacitive sensors;
- the handle is flush mounted in a door;
- the handle body extends outward from the door to an extended position;
- the handle body pivots between the stowed and extended positions;
- the handle pull determined on the first side of the handle body controls an actuator that opens or closes the door; and
- the handle pull determined on the first side of the handle controls a speed of the actuator.

According to another aspect of the present invention, a vehicle door handle is provided. The vehicle door handle includes a handle body having inner and outer sides, keypad contacts on the outer side, and a plurality of proximity sensors disposed on the handle body to generate activation fields extending on the inner and outer sides. The vehicle door handle also has a controller processing signals generated by the sensors to determine a handle pull on the inside surface and a keypad input on the outer surface.

Embodiments of the second aspect of the invention can include any one or a combination of the following features:

- the door handle further comprises a beam shaping shield located between the sensors and the outer side to generate a narrower beam sensing field on the outer side of the handle body for each proximity sensor;
- the beam shaping shield comprises a conductive layer having one or more holes for controlling shape of the activation fields extending on the outer side of the handle body;
- the plurality of proximity sensors comprises a plurality of capacitive sensors;
- the handle is flush mounted in a door in a stowed position
- the handle body extends outward from the door to an extended position;
- the handle body pivots between the stowed and extended positions; and
- the handle pull determined on the first side of the handle body controls an actuator that opens or closes the door.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
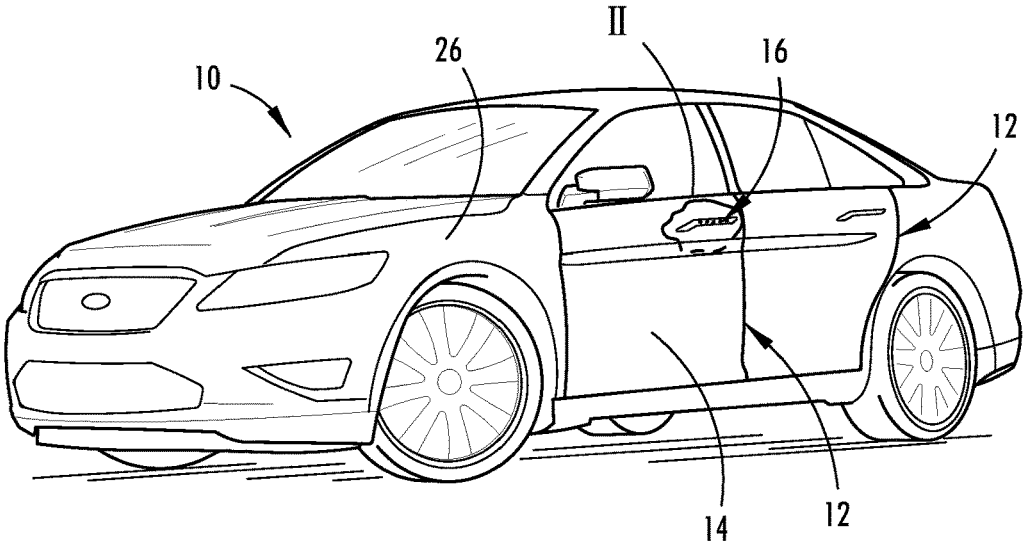
FIG. 1 is a side perspective view of a motor vehicle having doors equipped with a door handle having proximity sensed input controls, according to one embodiment.

For purposes of description herein, the terms "upper," "lower," "right," "left," "rear," "front," "vertical," "horizontal," "interior," "exterior" and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
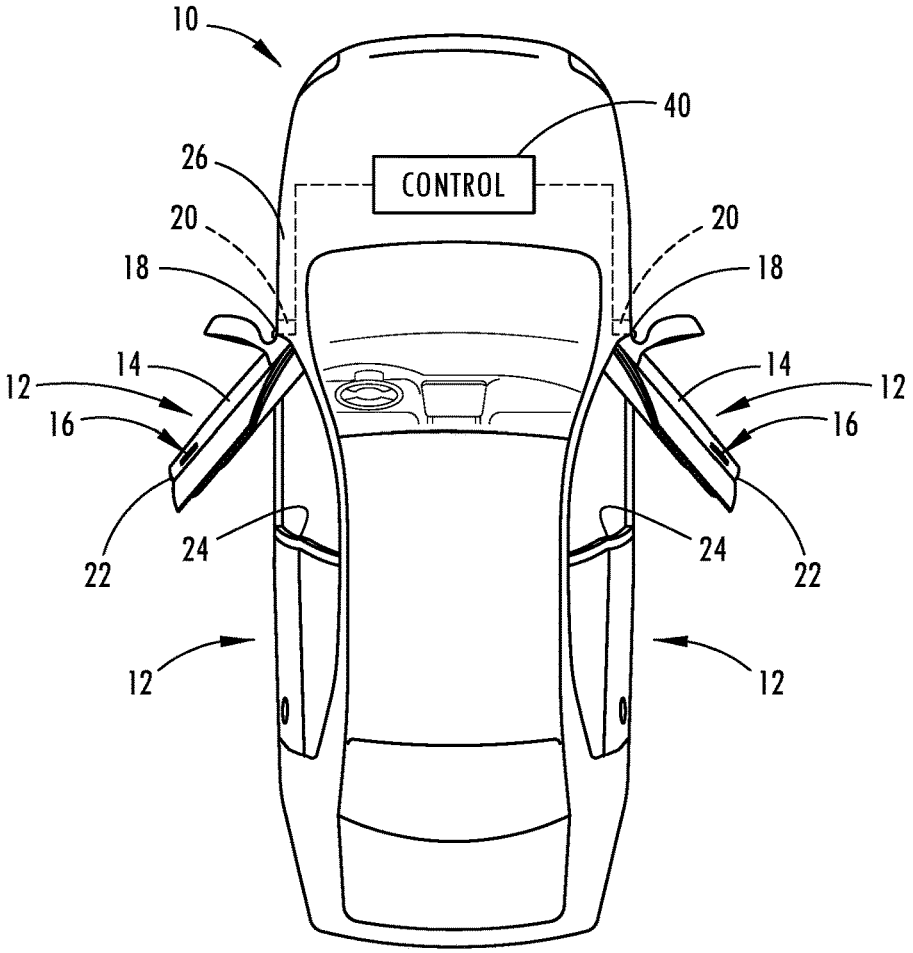
FIG. 2 is a top view of the vehicle further illustrating the two forwardmost powered doors in the open position.

Referring now to FIGS. 1 and 2, a wheeled motor vehicle 10 is generally illustrated having a plurality of variable-speed powered doors equipped with handles having proximity sensor based controls, according to one embodiment. The vehicle 10 includes vehicle doors 16 provided on opposite sides of the vehicle 10. In the embodiment shown, the vehicle 10 has a front door and a rear door on a first or driver's side of the vehicle 10 to enable the driver and passengers to enter and exit the seating compartment, and a front door and a rear door on the opposite second or passenger's side of the vehicle 10 to enable passengers to access the seating compartment from that side. The vehicle doors 12 each include a door panel 14 pivotally connected to a frame or body 26 of the vehicle 10. The connection between each door panel 14 and body 26 may include one or more hinge assemblies 18 that allow the door 12 to swing about the hinge assembly 18 between the closed and open positions. While the doors 12 are pivoting doors in the embodiment shown, it should be appreciate that one or more of the doors 12 could otherwise move between open and closed positions, such as sliding doors.

Each door 12 also includes a door handle 16 located on the exterior side of the door panel 14. The door handle 16 has a handle body shown and described herein as a flush mounted handle body in the stowed position that pivots and extends outward so that a user may grip the handle 16. The door handle 16 has a first contact surface on a first or inner side to enable a user to contact the door handle 16 to input door control commands such as a door unlatch command, a door open command, a door closing command and door opening speed command. The door handle 16 has a second contact surface, shown with five keypad contacts on a second or outer side to enable a user to input a door unlock/lock command. It should be appreciated that the door handle 16 may have other shapes, sizes and configurations.

The door 12 includes an actuator such as an electric motor 20 shown located near the hinge assembly 18. The motor 20 is actuatable in a first direction to open the door to an open position. The motor 20 may also be actuatable in the reverse second direction to close the door to a closed position. The actuator may operate at multiple speeds in response to a sensed user hand contacting the first contact surface on the inner side to input a door speed control command. For example, the door panel 14 may be opened at a first slow speed, or a second middle or normal speed which is faster than the first speed, or a fast third speed which is faster than the second speed, depending on the amount of contact area sensed on the first contact surface of the door handle by a proximity sensor arrangement. The activation may also close the door at one or more speeds.

The vehicle door 12 may further include a door latch lock assembly 22 configured to engage a latch mechanism 24 on the vehicle body 26 when the door panel 14 is in the closed position. The latch assembly 22 may be electronically controlled to latch and unlatch the door 12 based on a user input as sensed by the proximity sensor arrangement. For example, the latch assembly 22 may unlatch when a user's hand is detected or sensed contacting the first contact surface on the inner side of the door handle 16 and a vehicle key fob or other electronic device such as a smartphone is sensed in close proximity (e.g., within one meter) to the corresponding vehicle door 12. Once the door 12 is unlatched, the door 12 may be actuated to the open position when a door open command is detected. When the door is closed, the latch assembly 22 will latch onto the latch mechanism 24 on the vehicle body 26 to keep the door 12 latched in the closed position. It should be appreciated that various latch configurations may be used. It should also be appreciated that the door latch assembly 22 may otherwise be controlled with a key fob or with user input controls provided on the vehicle 10.

Figure 3:
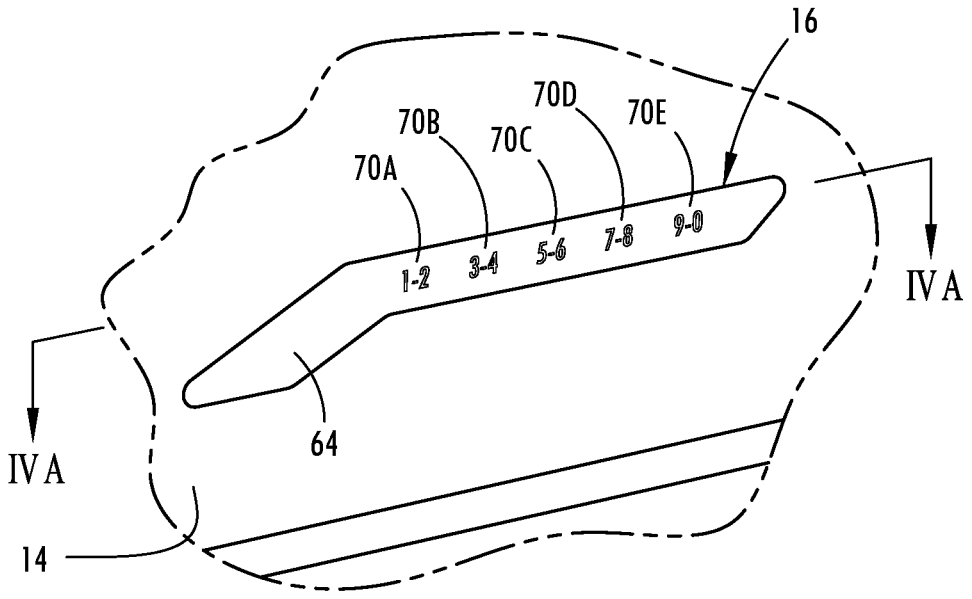
FIG. 3 is an enlarged view of section II of FIG. 1 further illustrating the vehicle door handle in the flush retracted stowed position.
Figure 4A:
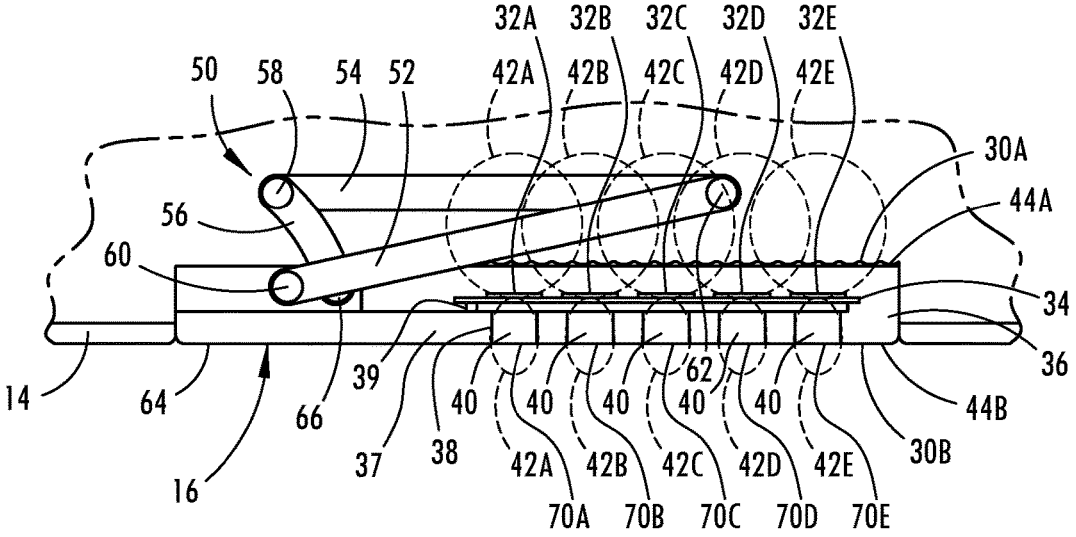
FIG. 4A is a schematic top cut away view of the door handle shown in the flush retracted stowed position.
Figure 4B:
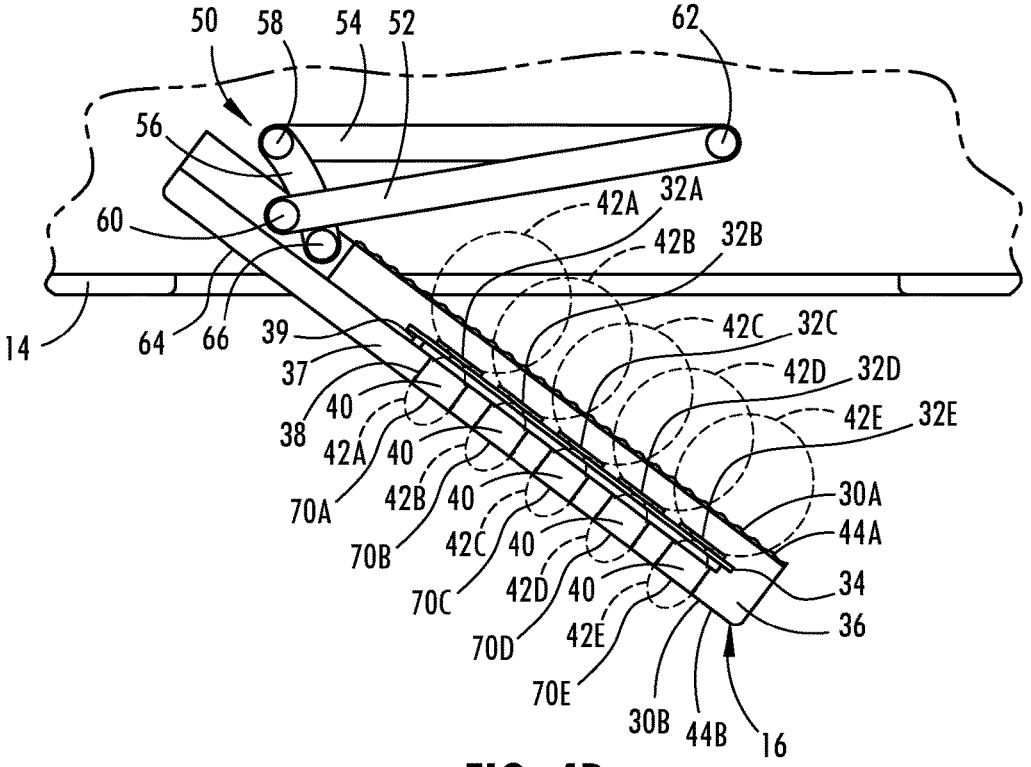
FIG. 4B is a schematic top cut away view of the handle shown in the extended position.

Referring to FIGS. 3-4B, the door 12 and the door handle 16 are further illustrated in greater detail in both flush stowed positions and outward extended positions. The door handle 16 is shown located on the exterior surface of the door panel 14 and is flush mounted within the door panel 14 when in the flush stowed position as shown in FIGS. 3 and 4A. The door handle 16 has a push portion 64 provided on the vehicle frontmost end thereof, which enables a user to apply force to push the push portion 64 inward to thereby pivot the vehicle rearwardmost portion of the handle 16 from the flush stowed position shown in FIG. 4A to the outward extended position shown in FIG. 4B. The handle 16 has a handle body 36 configured with a first or inner side 44A and a second or outer side 44B which is exposed to a user positioned outside of the vehicle 10. The outer side 44B of the handle 16 includes a plurality of keypad inputs 70A-70E, which enable a user to sequentially enter keypad inputs to unlock and lock the door. Thus, when the handle 16 is in the flush stowed position, the user may enter a sequence of codes on the keypad to unlock or lock the door latch lock assembly 22 on the door 12. The keypad inputs 70A-70E may be positioned on a flush surface or may have contoured touch pads.

Referring to FIGS. 4A and 4B, the door handle 16 is generally shown as a deployable handle that may deploy from the flush stowed position shown in FIG. 4A to an extended position shown in FIG. 4B in which the handle 16 is pivoted outward to enable a user to grip the handle 16 on the inner side 44A to enable the user to apply a handle pull force and input a door command signal to unlatch the door 12, actuate the door to the open position at a select speed, and to actuate the door to the closed position. The deployable door handle 16 pivots about a hinge assembly 50. The hinge assembly 50 may be configured to provide an over center pivoting rotation of the door handle 16. When a user applies sufficient force on the push portion 64, the hinge assembly 50 pivots the remaining portion of the handle 16 outward to the use position extending outward at an angle in the range of fifteen degrees to sixty degrees (15°-60°).

The hinge assembly 50 includes a first rod 52 pivotally connected on one end to one end of a second rod 54 via a first pivot pin 62. The opposite end of the first rod 52 is connected to a second pivot pin 60. The opposite end of the second rod 54 is connected to a third rod 56 via a third pivot pin 58. The opposite end of the third rod 56 is connected to a fourth pivot pin 66. Accordingly, the handle 16 is a mechanically deployable handle in the embodiment shown. However, it should be appreciated that the handle 16 may further include an actuator, such as a motor, to actuate the handle 16 between the flush mounted position and the extended position. It should further be appreciated that the handle 16 may otherwise be configured to move between the stowed and extended positions.

The powered door 12 includes a proximity sensor arrangement 32 located on the door handle 16 and configured to sense a user's hand interfacing with the door handle 16, particularly on the first contact surface 30A on the inner side 44A of the door handle 16. The proximity sensor arrangement 32 has one or more proximity sensors configured to sense a user in close proximity, e.g., within one millimeter, or in contact with the first contact surface 30A on the inner side 44A of the door handle 16 and on the second contact surface 30B on the outer side 44B of the door handle 16. In the embodiment shown, the proximity sensor arrangement 32 includes five proximity sensors 32A-32E shown evenly spaced along a length of the handle body 36 of the door handle 16 for generating corresponding sense activation fields 42A-42E. The sense activation fields 42A-42E operate as sensing fields and are shown extending on the inner side 44A of the handle 16 and overlapping with one another and sufficiently covering the first contact surface 30A and further extending on the outer side 44B of the handle 16 in narrow fields that do not overlap with each other and cover the second contact surface 30B which has keypad contact surfaces for five individual keypads. Each of the proximity sensors 32A-32E generates a sense activation field 42A-42E and generates a signal in response to sensed interference with the corresponding sense activation field. The signal generated with each proximity sensor 32A-32E is processed by a controller to detect the presence of a user e.g., hand of a user, within the sense activation field and generates a signal amplitude dependent upon the amount of interference or contact with the contact surface 30 on the inner side 44A or the outer side 44B within the sense activation field. For example, when a user's hand lightly touches the inner side 44A of the door handle 16, a relatively smaller amplitude signal is generated, whereas if the user pulls on the inner side 44A of the door handle 16 on the contact surface 30, the amount of signal amplitude generated by each sensor is greater.

The proximity sensors 32A-32E are located within a housing of the handle body 36 of door handle 16 in close proximity to the first contact surface 30A. The door handle 16, particularly the first contact surface 30 on the inner side 44A, is preferably made of a material, such as polymeric material, that does not interfere with the sense activation fields 42A-42E. The inner side 44B of the handle may have a roughened surface or gripping pattern for enhanced gripping. Each of the proximity sensors 32A-32E is located on a printed circuit board 34 which may include other electrical circuitry. The printed circuit board 34 includes a controller or control circuitry which may include a microprocessor which may be electrically connected to the proximity sensors 32A-32E and may process the signal generated by each of the sensors 30A-32E. It should be appreciated that each of the proximity sensors 32A-32E are located on one side of the printed circuit board 34 facing towards the first contact surface 30A on the inner side 44A of the door handle 16. A ground layer 37 is disposed on the opposite side of the printed circuit board 34 and thus is located on the side of the circuit board 34 generally facing towards the outer side 44B of the door handle 16. The ground layer 37 is made of an electrically conductive material that is grounded to an electrical ground. The ground layer 37 provides a beam shaping shield located between the sensors 32A-32E and the outer side 44B to generate a narrower sensing field on the outer side 44B of the handle body 36 for each sensor. The ground layer 37 has holes that allow a portion of the sense activation fields to extend therethrough to the outer side 44B and prevents a portion of the sense activation fields 42A-42E generated by each of the sensors 32A-32E from extending towards the outer side 44B of the door handle 16 while allowing the sense activation fields 42A-42E to extend towards the inner side 44A of the door handle 16 where the first contact surface 30A is located.

In the embodiment shown, the plurality of proximity sensors 32A-32E includes a linear array of five sensors, however, it should be appreciated that one or more proximity sensors may be employed in the array of proximity sensors. Additionally, it should be appreciated that the array of proximity sensors 32A-32E is configured to sense the proximity of objects located on an inside portion of the handle 16 at or near the contact surface 30 on the inner side 44A of the door handle 16 and keypad inputs on the outer side 44B of the handle 16, according to one embodiment. However, it should be appreciated that the array of proximity sensors 32A-32E may be provided on a different side of the door handle 16, according to other embodiments. It should further be appreciated that the variable-speed powered door 12 may be implemented on any side door of the vehicle 10 or another door of the vehicle, such as a vehicle tailgate or an interior door handle according to other embodiments.

The proximity sensors 32A-32E are shown and described herein as capacitive sensors, according to one embodiment. Each capacitive sensor includes at least one capacitive sensor that provides a sense activation field 42A-42E used as a sensing field to sense contact or close proximity (e.g., within one millimeter) of an object, such as the hand (e.g., palm and/or fingers) of a user or operator in relation to the one or more proximity sensors 32A-32E. The capacitive sensors may operate as a capacitive switch that may unlatch the door latch and may operate as a switch input to control the variable-speed of the door motor for opening the door and closing the door and may be used to detect keypad inputs. In this embodiment, the sense activation field of each proximity sensor is a capacitive field and the user's hand, including the palm, thumb and other fingers, has electrical conductivity and dielectric properties that cause a change or disturbance in the sense activation field as should be evident to those skilled in the art. However, it should be appreciated by those skilled in the art that additional or alternative types of proximity sensors can be used, such as, but not limited to inductive sensors, optical sensors, temperature sensors, resistive sensors, the like or a combination thereof. Exemplary proximity sensors are described in the Apr. 9, 2009, ATMEL® Touch Sensors Design Guide, 10620 D-AT42-04/09, the entire reference hereby being incorporated herein by reference.

Each of the capacitive sensors may be configured with electrical circuitry that may be printed with printed ink on a substrate and generally includes a drive electrode and a receive electrode, each having interdigitated fingers for generating a capacitive field, according to one embodiment. It should be appreciated that each of the proximity sensors 32A-32E may otherwise be formed. Each capacitive sensor may have a drive electrode that typically receives a square wave drive pulse applied at a voltage and a receive electrode that has an output for generating an output voltage. It should be appreciated that the electrodes may be arranged in various configurations for generating the capacitive field as the sense activation field.

In one embodiment, the drive electrode of each proximity sensor is applied with a voltage input as square wave pulses having a charge pulse cycle sufficient to charge the receive electrode to a desired voltage. The receive electrode thereby serves as a measurement electrode. When a user or operator, such as a user's hand or thumb or other fingers, enters a sense activation field associated with one of the sensors, the disturbance caused by the hand or fingers to the activation field is detected and a signal is generated. Each of the signals is processed by a controller to determine whether or not to unlatch the door latch, whether to control the actuator to control the opening speed of the door at a high, medium or low speed, whether to close the door or whether a keypad input to lock or unlock the door was detected, according to one embodiment. The disturbance of each sense activation field is detected by processing a charge pulse signal associated with the corresponding signal channel. When the user's hand or fingers enter the sense activation fields, the disturbance of each sense activation field is processed via separate signal channels.

The sense activation fields 42A-42E generated by each individual proximity sensor is shown in FIGS. 4A and 4B slightly overlapping on the first contact surface 30A on the inner side, however, it should be appreciated that the sense activation fields may be smaller or larger and may overlap more or less depending on the sensitivity of the individual sense activation fields. By employing a plurality of sense activation fields on the interior side of the handle 16 in close proximity to the first contact surface 30A, the size and shape of the hand and the amount of gripping contact with the first contact surface 30A may be determined based on the sensed signals. The amplitude of each signal may vary based on the size of the hand and the amount of contact on the first contact surface 30A where the sense activation field is located. Additionally, the amount of contact on the first contact surface 30A extending throughout the entire interior surface of the handle 16 may be determined by processing the signals that are generated with all five capacitive sensors. The sum total of two or more of the five signals or an average value of the signals generated by the capacitive sensors may be processed to determine the contact area on the first contact surface 30A and the user input command. Thus, one or all of the proximity sensors 32A-32E may sense the size of the contact area engaged by a user's hand on the first contact surface 30A.

When an initial contact or close contact of a hand is made with the first contact surface 30A on the inner side 44A of the door handle 16, an initial signal level may be established which may be used to unlatch the door 12, particularly when the user is detected in close proximity to the door with a key fob in possession. According to one embodiment, an initial level is established when the user inputs a door unlatch command. However, the initial signal level may be entered at other contact forces. Once unlatched, the door may be controlled to open with the actuator assist based on a user's input applied by the hand contacting the first contact surface 30A of the door handle 16. The actuator actuates the door opening at a first speed when a greater first size contact area is sensed relative to the initial contact. The actuator is controlled to actuate the door opening at a greater second speed when a greater second size contact area is sensed relative to the initial contact. The actuator is further controlled to actuate the door opening at a third speed when a larger third size contact area is sensed relative to the initial contact. Thus, a user may grab the handle 16 and unlatch the door such that the door is free from the body and may open, and then may proceed to apply a desired amount of force onto the first contact surface 30A by gripping the door handle 16 which flattens the hand and increases the contact area applied to the contact surface 30 on the inner side of the handle. The change in the sensed contact area is used to control the speed of the opening of the door with the actuator. By pulling on the door lightly, the first contact area is achieved, whereas by pulling on the door with a greater amount of force resulting in a greater contact with the contact surface 30 of the handle 16, a greater door opening speed may be achieved. By pulling even harder on the door with a greater force in a further enhanced contact surface may be achieved which causes yet a greater door opening speed. Additionally, by pulling on the door handle repeatedly with at least two pulls, a door input command for closing the door may be determined.

The second contact surface 30B on the outer side 44B of the door handle 16 is made up of individual keypad contacts that serve as keypad inputs for enabling a person to enter a sequence of inputs to lock and unlock the vehicle doors, according to one embodiment. The use of the keypad to lock and unlock the door(s) works well when the user does not possess the key fob. The user selectable input keypads are shown arranged horizontally on the driver side door, according to one embodiment. The input pads each define a region upon which a user may touch the input pad with a finger or come in close proximity thereto to enter an input selection. The input pads may each include lighted characters that include backlighting and illustrate numerical characters for a corresponding input entry. The characters may include numerical characters 1 and 2 (1-2) for the first input pad, numerical characters 3 and 4 (3-4) for the second input pad, numerical characters 5 and 6 (5-6) for the third input pad, numerical characters 7 and 8 (7-8) for the fourth input pad and numerical characters 9 and 0 (9-0) for the fifth input pad. It should be appreciated that other characters such as letters or symbols may be employed as input keypad identifiers. Each of the input keypads is aligned with one of the proximity sensors that passes to the second contact surface 30B on the outer side 44B of the handle 16 and senses contact or close proximity, e.g., within 1 millimeter of the user's finger with the corresponding keypad and defines a binary switch output (on or off) indicative of a user's selection of that corresponding input keypad.

The light illumination of each of the characters for the corresponding input pads may be achieved by employing a backlight source 39, such as one or more LEDs. The light source 39 is in optical communication with a light pipe 40 which extends through openings 38 in the ground layer 37. As such, light generated by the light source 39 illuminates each of the numerical characters on the outer side of the keypad.

A user may advantageously input a code as a sequence of inputs into the keypads to lock and unlock the vehicle door by entering a programmed sequence of input characters (e.g., numbers) via the keypads labeled with the identifier characters. In the locked state, the door latch assembly 22 is locked such that it will not be able to unlatch and open. When the user interacts with the sense activation field extending within one of the keypads, a signal associated with the corresponding proximity sensor is generated. It should be appreciated that the signal generated by the proximity sensors due to interaction with the sensed activation field on the outer surface 44B of the door will have a significantly smaller amplitude due to the reduced size and shape of the corresponding activation fields as compared to a signal generated when a user interacts with the first contact surface 30A on the inner side 44A of the handle 16 with a similar touch event. Accordingly, the controller may also determine a keypad input based on the lower amplitude and the individual activation of one keypad at a time, as opposed to detecting multiple signals sensing an object on the first contact surface 30A when a hand interacts with multiple fields at one time.

Figure 5:
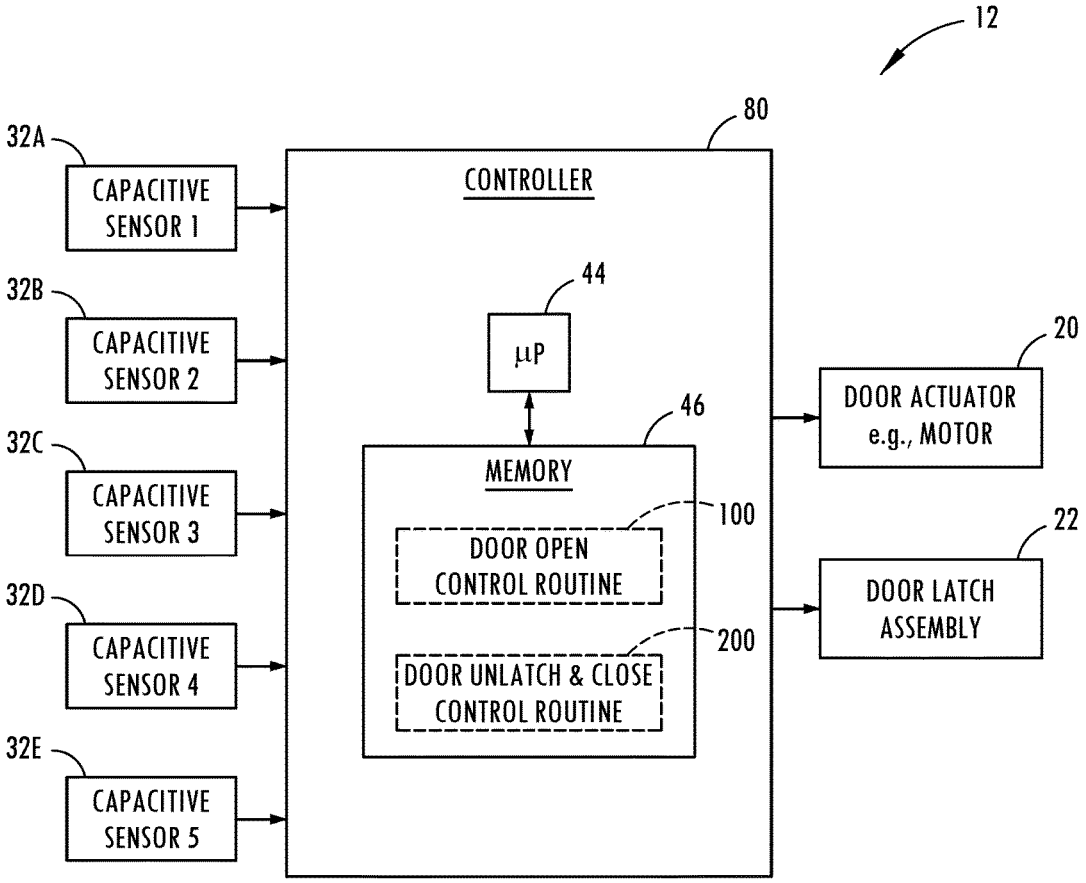
FIG. 5 is a block diagram illustrated controls for processing the proximity sensors associated with the door handle and controlling the door actuator and door unlock.

Referring to FIG. 5, the controller 40 for controlling the door latch assembly 22 and door actuator 20 for variable-speed door opening control of one of the doors is illustrated. The controller 40 may include a microprocessor 40 and memory 46. It should be appreciated that the controller 40 may include analog and/or digital circuitry. The controller 40 receives signals from each of the capacitive sensors 32A-32E associated with a door handle and, based on the amplitude and pattern of the signals, such as a sum total or an average of the five signals, controls the door latch assembly 22 and door actuator 20 for that door. The controller 40 processes the input signals pursuant to one or more control routines such as routines 100 and 200 which may be executed by the microprocessor 40.

Figure 6:
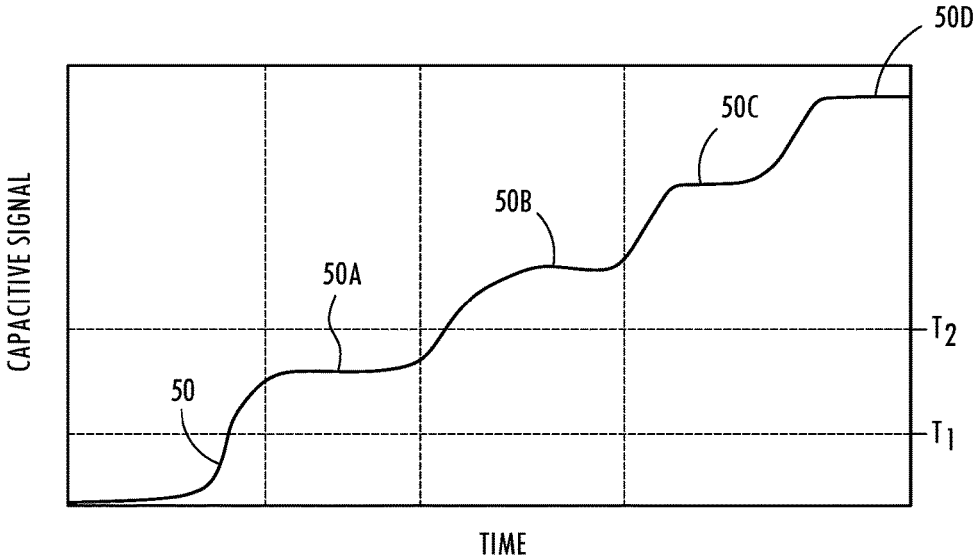
FIG. 6 is a signal diagram illustrating a signal generated with one of the proximity sensors when a user interfaces with the door handle to input variable speed door opening assist commands.

Referring to FIG. 6, one example of a signal generated by an average value of the five capacitive sensors is illustrated during a user input applied to the door handle in which the user sequentially moves the hand grip amongst a plurality of commands including a door unlatch command and three varying speed door opening commands. The signal amplitude is a function of the sensor count as a function of time and indicates the amount of contact area contacted on the contact surface. As a user's hand approaches the contact surface on the handle, a disruption in the sense activation field is realized which causes the signal to increase in amplitude.

The signal 50 is shown rising up during an initial contact of the user's hand with the contact surface and exceeding a first threshold $T_1$ which is a low threshold used to determine a door unlatch input. When the signal 50 is substantially level, such as shown by signal portion 50A above threshold $T_1$, the controller 40 may control the door latch to unlatch the door provided the user is determined to have door opening access such as being in possession of a key fob in close proximity to the door. The amplitude of the signal at signal portion 50A may be used to establish and store an initial signal level in memory. The signal 50 is further shown rising above a second higher threshold $T_2$ which is a threshold above which the signal must exceed in order to detect a speed control input for opening the door. The signal 50 rises up to a substantially stable signal on portion 50B above threshold $T_2$. If the signal 50 has increased by twenty percent (20%) over the initial signal level, a slow door open input is determined and the controller controls the actuator to open the door at a slow first speed. If the signal increases by forty percent (40%) over the initial signal as shown by portion 50C, the controller controls the actuator to open the door at a normal second speed which is greater than the first speed. If the signal increases by sixty percent (60%) or greater over the initial signal as shown by portion 50D, the controller controls the actuator to open the door at a faster third speed which is greater than the second speed. As such, the speed of the door opening can be controlled by the amount of force applied to the door handle which increases the amount of surface area of the hand on the first contact surface as sensed by the proximity sensors.

Figure 7:
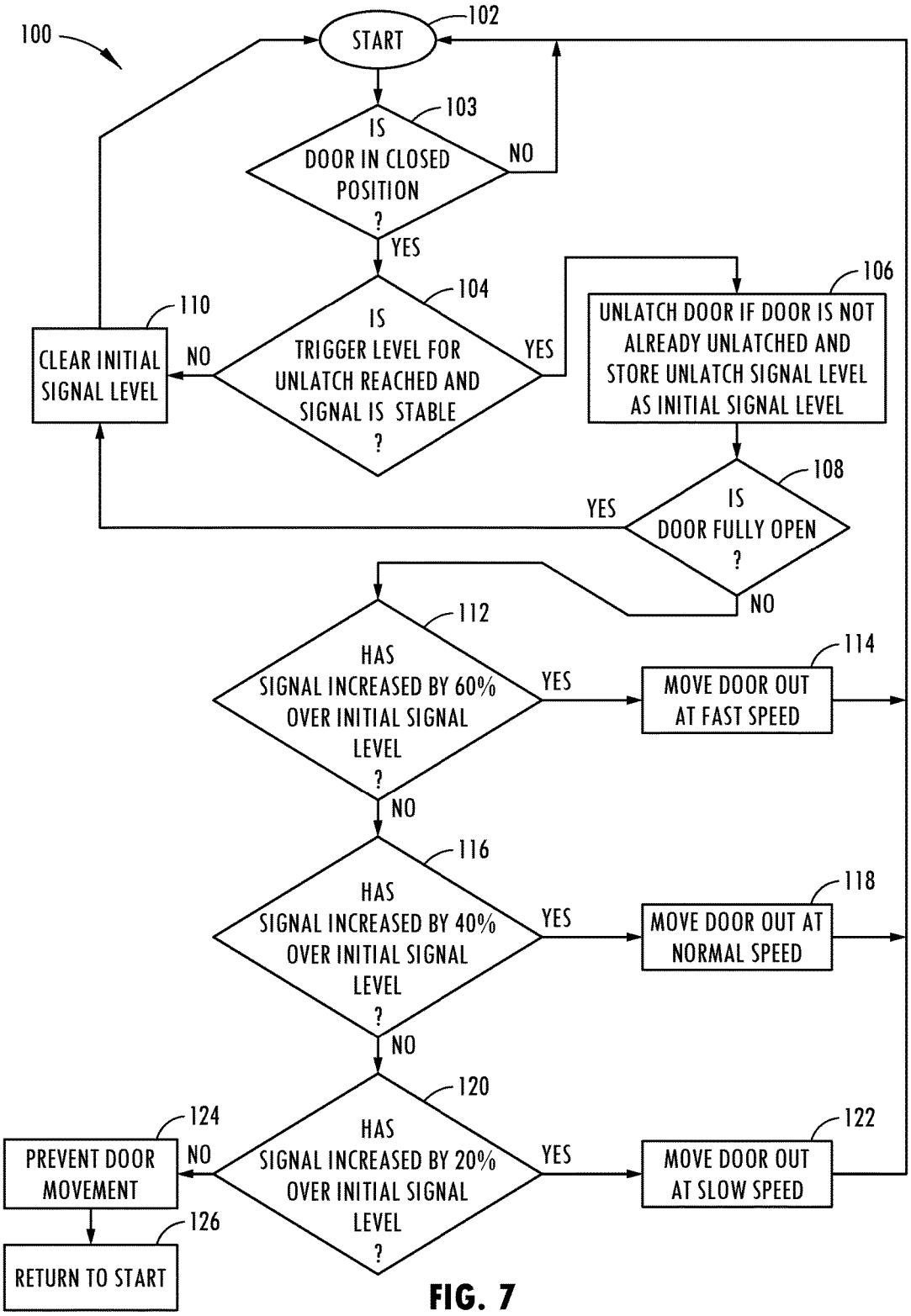
FIG. 7 is a signal diagram illustrating a signal generated with one of the proximity sensors when a user interfaces with the door handle to input door opening and closing commands.

Referring to FIG. 7, a routine 100 for controlling the variable-speed power door is illustrated, according to one embodiment. Routine 100 begins at step 102 and proceeds to step 103 to determine if the door is in the closed position and, if not, returns to step 102. If the door is in the closed position, routine 100 proceeds to step 104 to determine if the trigger level for the door unlatch is reached and if the signal is stable and, if not, clears the initial signal and returns to step 102. If the trigger level for the door unlatch is reached and the signal is stable, routine 100 proceeds to step 106 to unlatch the door if the door is not already unlatched and to store the unlatch signal level as the initial signal level. Next, routine 100 proceeds to step 108 to determine if the door is fully open and, if so, proceeds to step 110 to clear the initial signal level before returning.

If the door is fully open, routine 100 proceeds to decision step 112 to determine if the signal has increased by sixty percent (60%) over the initial signal level and, if so, moves the door at the fast third speed before returning to step 102. Next, at decision step 116, routine 100 determines if the signal has increased by forty percent (40%) over the initial signal level and, if so, moves the door out at the normal second speed at step 118, before returning to step 102. Next, at decision step 120, routine 100 determines if the signal has increased by twenty percent (20%) over the initial signal level and, if so, moves the door out at the slow first speed at step 122 before returning to step 102. If the signal has not increased by twenty percent (20%) over the initial signal level, routine 100 proceeds to step 124 to prevent door movement and then returns to start at step 126.

Figure 8:
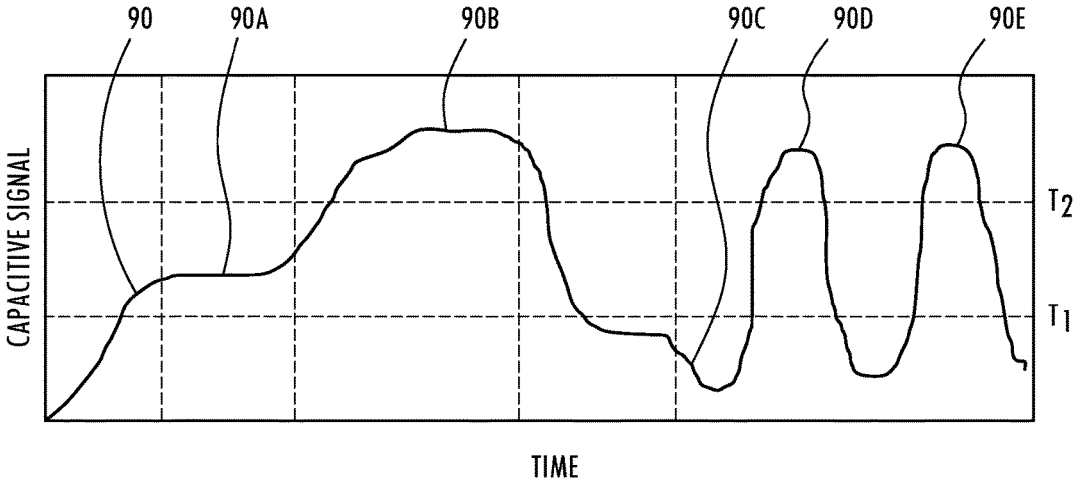
FIG. 8 is a flow diagram illustrating a routine for controlling the door latch and door actuator opening speed with the powered door, according to one embodiment.

Referring to FIG. 8, one example of a signal generated by an average value of the five capacitive sensors is illustrated during a user input command to the door handle in which the user initially grasps the handle to unlatch the door, then grips or squeezes on the handle to a create a higher signal to open the door, then releases the grip on the handle and makes two consecutive squeezes or pulls on the handle to command the power door closure. The signal 90 is shown initially rising up during the initial contact of the user's hand with the contact surface and exceeding a first threshold $T_1$ which is the lower threshold used to determine the door unlatch input. When the signal 90 is substantially level, such as shown by the signal portion 90A above threshold $T_1$, the controller 40 may control the door latch to unlatch the door, provided the user is determined to have door opening access such as being in possession of a key fob in close proximity to the door. The amplitude of the signal at signal portion 90B may be used to establish and store the initial signal level in memory. The signal 90 is further shown rising above a second higher threshold $T_2$ which is a threshold above which the signal must exceed in order to detect a door open command at signal portion 90B. The signal then drops off when the user releases the handle such as shown by signal portion 90C. Thereafter, the user repeatedly grips the handle with two sequential quick squeezes or pulls on the first contact surface of the handle within a short time period to input a power door close command as shown by signals 90D and 90E which causes the actuator to close the door.

Figure 9:
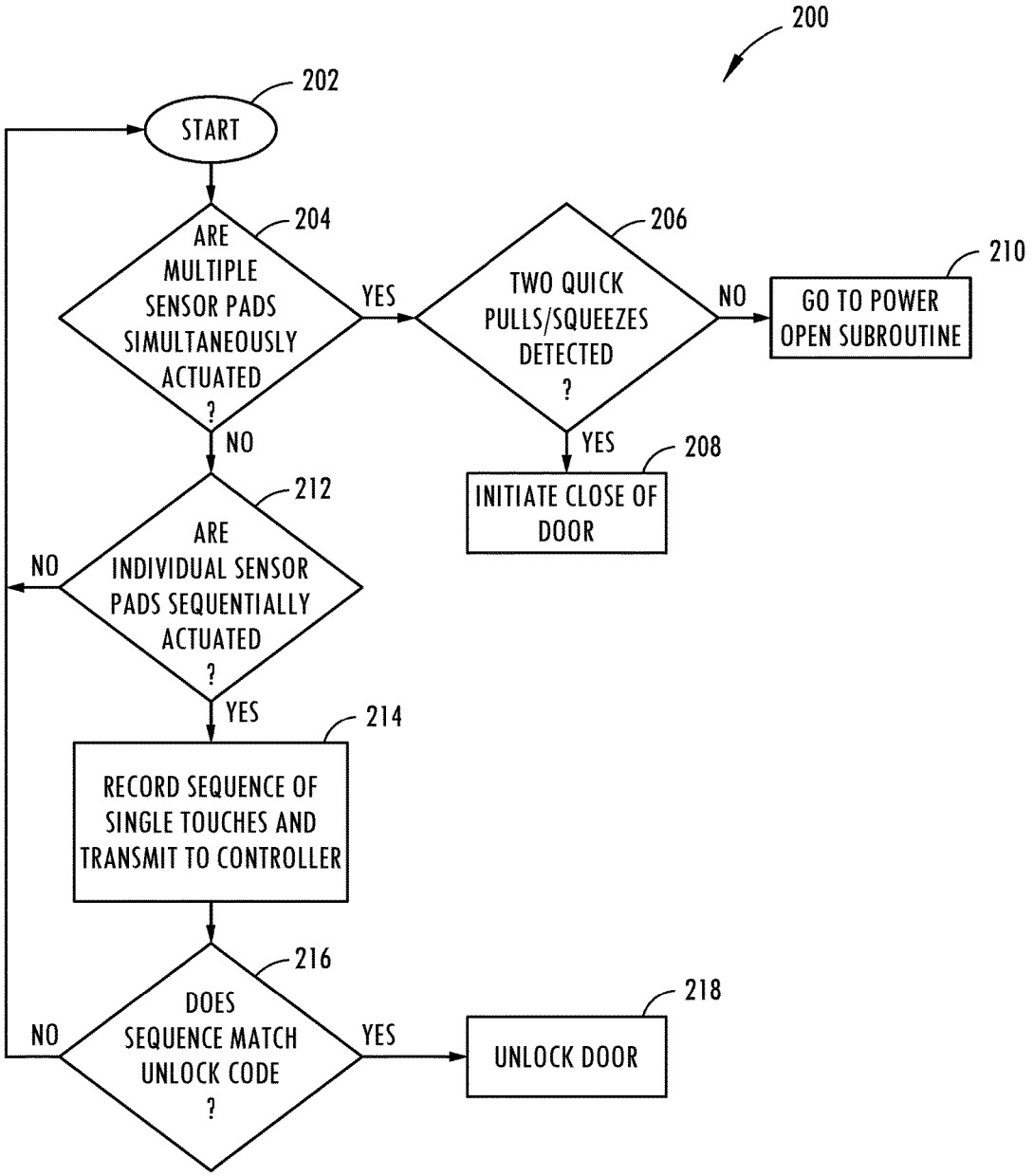
FIG. 9 is a flow diagram illustrating a routine for controlling the door closing and keypad input, according to one embodiment.

Referring to FIG. 9, a routine for controller 200 the power door to close the door with user commands input on the first contact surface and to control the door locks with the keypads on the second contact surface is illustrated, according to one embodiment. Routine 200 begins at step 202 and proceeds to step 204 to determine if multiple sensors or sensor pads are actuated simultaneously, and, if so, routine 200 will determine that the first contact surface is likely engaged. If multiple sensor pads are actuated simultaneously, routine 200 proceeds to step 206 to determine if two quick pulls or squeezes on the first contact surface of the handle are detected and, if so, proceeds to step 208 to initiate closing of the door with the actuator. If not, routine 200 proceeds to step 210 to proceed to the power open door routine shown in FIG. 7.

If multiple sensor pads are not simultaneously actuated, routine 200 proceeds to step 212 to determine if individual pads are sequentially actuated and, if not, returns to step 202. If individual sensor pads are sequentially activated, method 200 proceeds to step 214 to record the sequence of single activations or touches and to transmit the single touches to the controller. It should be appreciated that individual sequentially activated pads is presumed to be activation of the keypad on the second contact surface to input a door lock or unlock command. Following step 214, routine 200 proceeds to step 216 to determine if the keypad sequence matches an unlock code and, if so, proceeds to step 218 to unlock the doors. It should be appreciated that the routine 200 may use the sequence of codes to lock the door, similarly.

Accordingly, it should be appreciated that the door 12 advantageously controls the door latch and actuator based on varying levels of effort of a user applying force or contact onto a first contact surface on the door handle and also provides keypad inputs on the second contact surface with a shared plurality of proximity sensors. As a result, the powered door opening assist provides for enhanced door opening functionality.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door handle comprising:

a handle body having first and second sides;

a plurality of proximity sensors disposed on the handle body and generating activation fields, wherein each of the plurality of proximity sensors generates an activation field on both the first and second sides;

wherein the first side of the handle body is an inner side and the second side of the handle body is an outer side;

a beam shaping shield located between the sensors and the outer side to generate a narrower sensing field on the outer side of the handle hod as compared to the inner side of the handle body for each proximity sensor, and a controller processing signals generated by the sensors to determine a handle pull on the first side and a keypad input on the second side.

2. The door handle of claim 1, wherein the plurality of proximity sensors generate the activation fields to extend on the first side and the second side of the handle body.

3. The door handle of claim 1, wherein the beam shaping shield comprises a conductive layer having one or more holes for controlling shape of the activation fields extending on the outer side of the handle body.

4. The door handle of claim 3 further comprising a plurality of keypad contact surfaces on the outer side of the handle body.

5. The door handle of claim 1, wherein the plurality of proximity sensors comprises a plurality of capacitive sensors.

6. The door handle of claim 1, wherein the handle is flush mounted in a door in a stowed position.

7. The door handle of claim 6, wherein the handle body extends outward from the door to an extended position.

8. The door handle of claim 7, wherein the handle body pivots between the stowed and extended positions.

9. The door handle of claim 1, wherein the handle pull determined on the first side of the handle body controls an actuation that opens or closes the door.

10. The door handle of claim 9, wherein the handle pull determined on the first side of the handle controls a speed of the actuator.

11. A vehicle door handle comprising:

a handle body having inner and outer sides;

keypad contacts on the outer side;

a plurality of proximity sensors disposed on the handle body to generate activation fields extending on the inner and outer sides, wherein each of the plurality of proximity sensors generates an activation field on both the inner and outer sides;

a beam shaping shield located between the sensors and the outer side to generate a narrower beam sensing field on the outer side of the handle body as compared to the inner side of the handle body for each proximity sensor, and a controller processing signals generated by the sensors to determine a handle pull on the inner side and a keypad input on the outer side.

12. The door handle of claim 11, wherein the beam shaping shield comprises a conductive layer having one or more holes for controlling shape of the activation fields extending on the outer side of the handle body.

13. The door handle of claim 11, wherein the plurality of proximity sensors comprises a plurality of capacitive sensors.

14. The door handle of claim 11, wherein the handle is flush mounted in a door.

15. The door handle of claim 11, wherein the handle body extends outward from the door to an extended position.

16. The door handle of claim 11, wherein the handle body pivots between the stowed and extended positions.

17. A vehicle door handle comprising:

a handle body having inner and outer sides;

a plurality of proximity sensors disposed on the handle body and generating activation fields;

a controller processing signals generated by the sensors to determine a handle pull on the inner side and a keypad input on the outer side; and a beam shaping shield located between the sensors and the outer side to generate a narrower sensing field on the outer side of the handle body as compared to the inner side of the handle body for each proximity sensor.

* * * * *